US008651317B2

(12) United States Patent
Wolf

(10) Patent No.: US 8,651,317 B2
(45) Date of Patent: Feb. 18, 2014

(54) STORAGE CONTAINER COVER

(76) Inventor: Aaron Wolf, Savage, MN (US)

( * ) Notice: Subject to any disclaimer, the term of this patent is extended or adjusted under 35 U.S.C. 154(b) by 1013 days.

(21) Appl. No.: 12/660,911

(22) Filed: Mar. 5, 2010

(65) Prior Publication Data

US 2010/0170908 A1 Jul. 8, 2010

Related U.S. Application Data

(63) Continuation-in-part of application No. 12/011,600, filed on Jan. 28, 2008, now Pat. No. 8,141,742.

(51) Int. Cl.
*B65D 25/22* (2006.01)
*B65D 55/00* (2006.01)

(52) U.S. Cl.
USPC ..... 220/751; 220/9.2; 220/212

(58) Field of Classification Search
USPC ..... 220/751, 1.5, 9.2, 212
See application file for complete search history.

(56) References Cited

U.S. PATENT DOCUMENTS 4,144,984 A * 3/1979 Saunders ..... 220/1.5
4,577,772 A * 3/1986 Bigliardi ..... 220/1.5
5,281,073 A * 1/1994 Gesuale ..... 414/421
5,378,106 A * 1/1995 Risley et al. ..... 414/608
5,950,373 A * 9/1999 von Hoff et al. ..... 52/79.5
6,367,630 B1 * 4/2002 Elskamp ..... 206/508
6,454,112 B1 * 9/2002 Walters et al. ..... 220/1.5
7,011,214 B2 * 3/2006 Brackmann et al. ..... 206/509
7,017,741 B1 * 3/2006 Williamson ..... 206/386
7,689,481 B2 * 3/2010 Seagle et al. ..... 705/28

* cited by examiner

*Primary Examiner* — Mickey Yu
*Assistant Examiner* — Niki Eloshway
(74) *Attorney, Agent, or Firm* — DL Tschida

(57) ABSTRACT

Molded plastic cover pieces and mating fabric or hard-side sidewall panel assemblies are disclosed for mounting over a storage container. The cover piece provides several raised rails at perimeter edges and rails defining tine receiving lifting channels that contain sub-frame members that stiffen the cover and facilitate attachment of the cover and side walls to form a complete cover assembly. Single panel and thermally bonded multi-panel cover assemblies are disclosed. Bracing members and/or embossed surfaces at the rails and tine receiving channel cover pieces strengthen the covers and direct water runoff Fabric or expansible hinges provide flexible transitions at intersecting sidewall corners. Alternative cover assemblies provide lifting towers, panels with tine receiving apertures or interconnected tension members.

18 Claims, 17 Drawing Sheets

STORAGE CONTAINER COVER

RELATED APPLICATION DATA

This is a continuation-in-part of application Ser. No. 12/011,600 filed Jan. 28, 2008, now U.S. Pat. No. 8,141,742 which is a non-provisional application of design application Ser. No. 29/268,905 filed Nov. 15, 2006, now Des 575,062.

BACKGROUND OF THE INVENTION

The present invention relates to commercial transport and storage containers and in particular to an assembly having a hard cover and from which an attached fabric or hard sidewall assembly depends and which assembly mounts to cover a wooden storage/transport container.

Wooden containers have long existed for storing and transporting all kinds and types of devices and commodities. The shipping, trucking and warehousing industries use the containers to safely contain stored contents during shipping and storage. The containers can be constructed to any desired size and shape.

The multi-wall containers are typically constructed of wood with a top, sidewalls and a skid type bottom that accommodates handling with a forklift. For warehousing applications the containers are typically constructed of plywood in rectangular box shapes, for example, 5 feet wide, 8 feet deep and 7 to 8 feet high. One or more of the sidewalls are typically hinged to permit limited access to add or remove items. Stored contents are placed in the container and the container is stacked in a warehouse facility or located at other available storage space. The rectangular symmetry of the containers facilitates stacking and side-by-side placement.

Occasionally, the containers are moved to locations that aren't inherently weatherproof In this instance, a sewn vinyl fabric cover is frequently mounted over the container. The cover is typically fitted over the container with the aid of a fork lift or ladder to provide a warehouse worker sufficient height to place the cover over the container and position it to drape over the container sidewalls. The fabric cover can include detachable flaps to facilitate mounting and entry to the container at any available hinged walls. The fabric covers typically contain graphics and/or textual information.

Although fabric covers of the foregoing type substantially weatherize the covered container and contents, the fabric covers are subject to relatively short lives due to the typical shipping/warehouse environment. Damage from tearing and abrasion most frequently occurs from the stresses of handling and contact with fork lifts and other containers.

The present invention was developed to provide a load bearing hard cap or cover assembly for a storage container. The cover can be used alone or in combination with improved fabric and/or plastic sidewalls mounted to the cover. The cover is constructed to be accessible to handling from the sides with a forklift and provides a surface that vertically indexes to other containers to permit limited stacking. The cover can be fitted by itself to a container to substantially weatherize the container from nominal rain, snow and exposure to the elements. The cover can also be adapted to support attached fabric and/or plastic sidewalls having flexible hinged sections to define a complete weatherproof cover assembly.

SUMMARY OF THE INVENTION

It is a primary object of the invention to provide a hard cover or cap piece for a storage container that is adapted to handling with a forklift.

It is further object of the invention to provide a molded cover piece having tine receiving ports and supports that define tine receiving channels whereby the cover piece can be raised and maneuvered with a fork lift or other similar device.

It is further object of the invention to provide a cover piece that includes an integrated sub frame assembly to add rigidity to the cover piece.

It is an object of the invention to provide a sub frame assembly that anchors associated fabric or plastic sidewalls to the cover piece.

It is further object of the invention to provide a plastic sidewall assembly having flexible hinge portions.

It is further object of the invention to provide a plastic sidewall assembly having plastic hinge portions with folded webs (e.g. accordion shaped).

It is further object of the invention to provide a variety of alternative cover piece constructions.

It is further object of the invention to provide a two-section molded cover having a molded cap piece fastened or bonded to a molded base piece and/or any included sub frame members.

It is further object of the invention to provide a two-section molded cover having a molded cap piece thermally bonded to a molded base piece and wherein the base piece includes integral trusses or gussets that transversely project from sidewalls of raised longitudinal rails that define perimeter edges and tine receiving channels at the base piece and which rails can contain stiffener supports (e.g. wood).

It is further object of the invention to provide a two-section molded cover having raised strap support surfaces and channels formed into the cover.

It is further object of the invention to provide a two-section molded cover wherein a cap piece thermally bonds to the tops of perimeter rails, tine receiving channel rails, and raised strap channel pockets at the base piece.

It is further object of the invention to provide a two-section molded cover having a molded cap piece bonded to a molded base piece wherein raised or embossed surfaces (e.g. chevron, rectangular or ladder shapes having raised longitudinal and transverse segments, among other suitable designs and shapes) are provided at the cap piece and aligned to add rigidity and strength to the cover.

The foregoing objects, advantages and distinctions of the invention are obtained in several alternative storage container cover assemblies. In a first construction, a molded, hard plastic cover provides a plurality of raised channels that separately support a sub frame assembly. Layered members of a wooden sub frame mount in and span the channels and anchor associated fabric or plastic side walls secured to the molded cover piece.

Cross pieces fitted to the cover piece define associated apertures and/or channels that are located to receive the tines of a fork lift or other lifting device to permit attachment or removal of the cover piece from a lower lying storage container. Truss pieces formed or integrated with or fastened to the channel pieces add strength to the cover and the tine receiving cavities defined between the channels and control water runoff from the cover.

Alternative sidewall assemblies constructed of fabric panels ((e.g. vinyl, plastic or other hardened materials (e.g. pvc, nylon, high molecular weight polyethylene (HMWPE), ultra high molecular weight materials (UHMW) or composites)) are also disclosed. Flexible hinge pieces mounted between the fabric and/or plastic panels provide flexible transitions that facilitate the mounting and removal of the cover piece and/or sidewall assembly. Flexible plastic hinge strips with folded webs (e.g. accordion shaped) are also disclosed that are attached or molded to the sidewall panels of a plastic walled assembly.

Several alternative two-section molded covers are also disclosed. Each cover provides a molded base piece and a molded cap piece. The cap piece is bonded or fastened to the base piece. The base and cap piece are preferably thermally bonded to each other. Trusses or gussets are molded to integrally and transversely project from perimeter edge rails and raised longitudinal rails that define sidewalls of tine receiving channels at the base piece. Raised strap support pockets can be formed intermediate the longitudinal rails to align with and strengthen a strap receiving channel formed into the cover. Wooden sub-frame members are or can be secured to underlying cavity spaces at the perimeter and tine channel defining rails.

The cap piece fastens to the base piece rails to cover longitudinal tine receiving channels and strap receiving channels. The cap piece typically extends the length of the cover piece and can partially or completely span the width or length of the base piece. The cap piece is bonded (e.g. thermal bonding) to the tops of the adjacent rails of the tine receiving channels, raised strap pockets and perimeter rails. Raised or embossed surfaces are provided at the cap piece and aligned to overly the tine receiving channels and/or the perimeter or longitudinal tine channel sidewall rails to add rigidity and strengthen the cover. The embossed surfaces can exhibit chevron, rectangular or a ladder shapes having a longitudinal and transverse raised transverse segments, among other suitable designs.

Still other objects, advantages, distinctions, constructions and combinations of individual features of the invention will become more apparent from the following description with respect to the appended drawings. Similar components and assemblies are referred to in the various drawings with similar alphanumeric reference characters. The description to each combination should therefore not be literally construed in limitation of the invention. Rather, the invention should be interpreted within the broad scope of the further appended claims.

DESCRIPTION OF THE PREFERRED EMBODIMENTS

Figure 1:
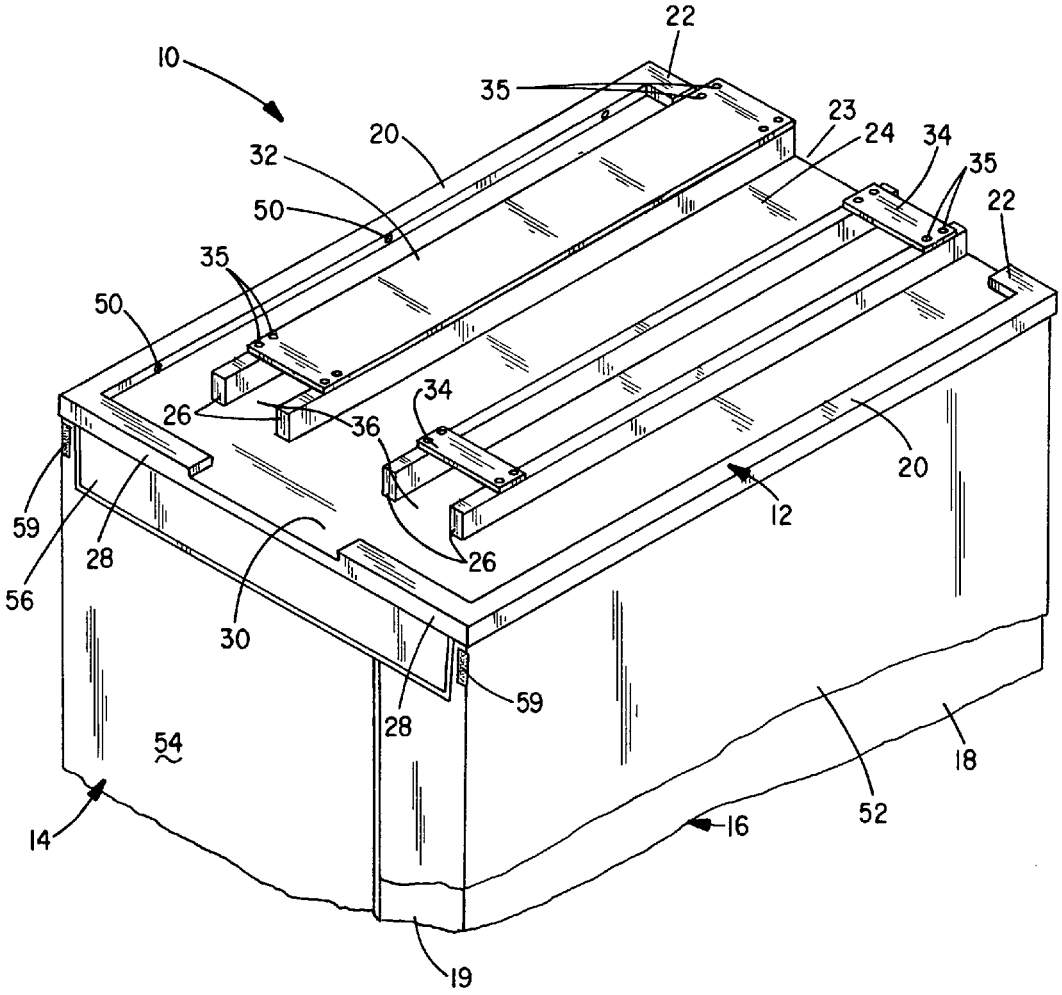
FIG. 1 is a perspective view showing front, left side and top views to an improved storage container cover having a molded (e.g. thermo formed) plastic cover piece and an attached fabric sidewall assembly.

With attention to the perspective view of FIG. 1, an improved storage container cover 10 having a molded plastic cover piece 12 and an attached fabric sidewall assembly 14 are shown. The cover 10 is mounted over a partially exposed typical storage container 16.

The container 16 is constructed of several wood panels (e.g. plywood) that define a top wall, depending sidewalls 18, a hinged door 19 and a floor/bottom (not shown). The container 16 is constructed in a rectangular box configuration and nominal size (e.g. 5 feet wide, 7 to 8 feet deep, and 7 to 8 feet high) compatible with various shipping vehicles and storage handling equipment. The floor/bottom is configured to accommodate lifting and transport of the container 10 with a conventional fork lift or may be secured to or contain a pallet-type frame. Similarly the cover piece 12 is adapted to fork lift handling.

The cover piece 12 is thermo formed from a suitable sheet stock plastic material (e.g. pvc, nylon, HMWPE, UHMW or other composites). The cover piece 12 provides right and left longitudinal peripheral side rails 20. Abbreviated corner rail sections 22 extend transversely from an aft end of the side rails 20. The rail sections 22 are interrupted by an open span or space 23 that exposes a flat region or top panel 24 and several raised longitudinal channel rails 26 that extend intermediate and parallel to the side rails 20. The channel rails 26 extend substantially the length of the top panel 24.

Corner rail sections 28 transversely extend from the fore end of the side rails 20 and expose a recessed end space 30. The end spaces 23 and 30 relieve water, snow, ice etc. that collects on the top panel 24. The rail sections 20, 22, 26 and 28 exhibit inverted, open-sided cavities of a desired shape (e.g. U or V shapes) when viewed on end or in transverse cross section, although could exhibit a variety of other open-sided shapes. The rail cavity spaces support strengthening devices discussed below. The outer flange of the rails 20, 22 and 28 depend below the top panel 24 to align and prevent lateral movement of the cover 10 relative to the lower lying container 19.

Full or partial length cross plates 32 and 34 are secured between and cover portions of adjoining channel rails 26 to define underlying lifting channels 36 that for example receive the tines of a fork lift or other lifting device. The plates 32 and 34 are secured with suitable fasteners 35 and support the weight of the storage container cover 10 when engaged by suitably spaced fork lift tines or other lifting devices. The arrangement of the plates 32 and 34 depict alternative forms of possible cover assemblies wherein both sets of the channel rails 26 are normally capped in similar fashion with the same cross plate(s) 32 or 34 such that both tine receiving lifting channels 36 are either fully or partially enclosed.

Figure 2:
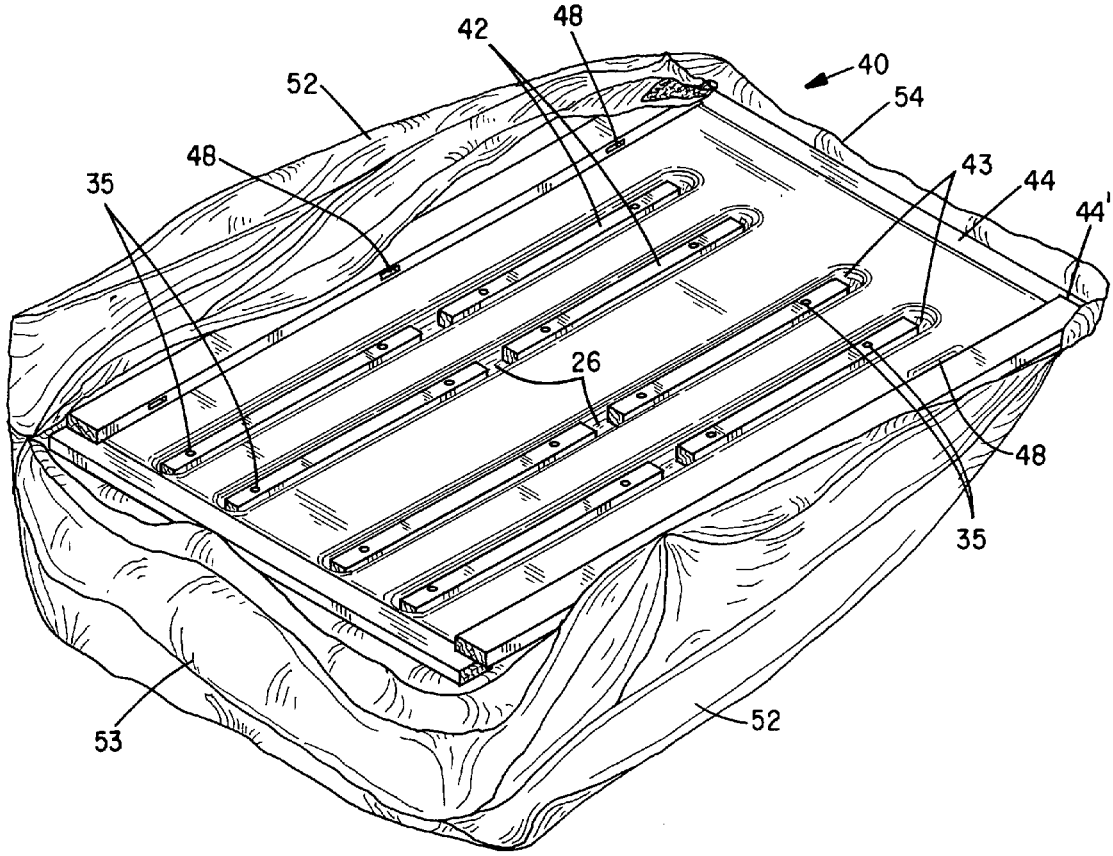
FIG. 2 is a perspective view shown in exploded assembly of a wooden sub frame assembly that attaches to the cover piece and clamps the sidewall assembly to the storage container cover of FIG. 1.

The rails 20, 22, 26 and 28 are sized to support and contain the members of a sub frame assembly 40 shown at FIG. 2. With attention to FIG. 2, the sub frame 40 is presently constructed of wooden 2×4's or stiffeners 42 and 44 that are contained within and below the rails 20, 22, 26, and 28. The stiffeners 42 mount in cavity spaces 43 at the channel rails 26 and are secured in place with the fasteners 35 that extend through the cross plates 32 or 34, the top panel 24, and stiffeners 42. The stiffeners 42 provide rigidity and distribute the weight of any overlying storage container 16 that might be mounted on top of the cover piece 12 and covered container 16. The stiffeners 42 and 44 can be constructed of other materials and may extend only partially along the rail cavity spaces. Cross braces or truss members may also be molded into the cavity spaces in honeycomb fashion.

The stiffeners 44 circumscribe the periphery of the cover piece 12 and fasten to the rails 20, 22 and 28. Overlapped stiffeners 44' mount to the stiffeners 44. The stiffeners 44 and 44' clamp fabric panels 52, 53 and 54 of the sidewall assembly 14 to the cover piece 12. Slots 48 are formed into the overlapped stiffeners 44 and 44' and receive blind fasteners 50 that extend through the sides of the side rail channels 20. With attention to FIGS. 1 and 2 and the sidewall assembly 14, side, end and door wall panels 52, 53 and 54 are fastened to the cover 12 and drape over the container 16. The door wall panel 54 is constructed with a top edge panel 56 that transversely spans the front of the container 16 and overlaps the hinged door 19. Mating hook and loop tabs 59 are appropriately located to the door hinge panel 56 and door panel 54. The tabs 59 retain the door panel 54 in a closed condition and to the adjoining side wall panel 52 in a folded open condition when the container door 19 is open.

The sidewall assembly 14 can be constructed of a variety of different weather and UV resistant fabrics, canvas and/or coated materials. Such materials are sufficiently flexible to facilitate fitting the assembly 17 over the container 16 as the cover piece 12 is located and the panels 52, 53 and 54 are aligned to the container 16. Although fabric is suitable for many applications and provides cost advantages, many applications are better served with a hard side wall assembly 60 such as shown in FIGS. 3 and 4.

Figure 3:
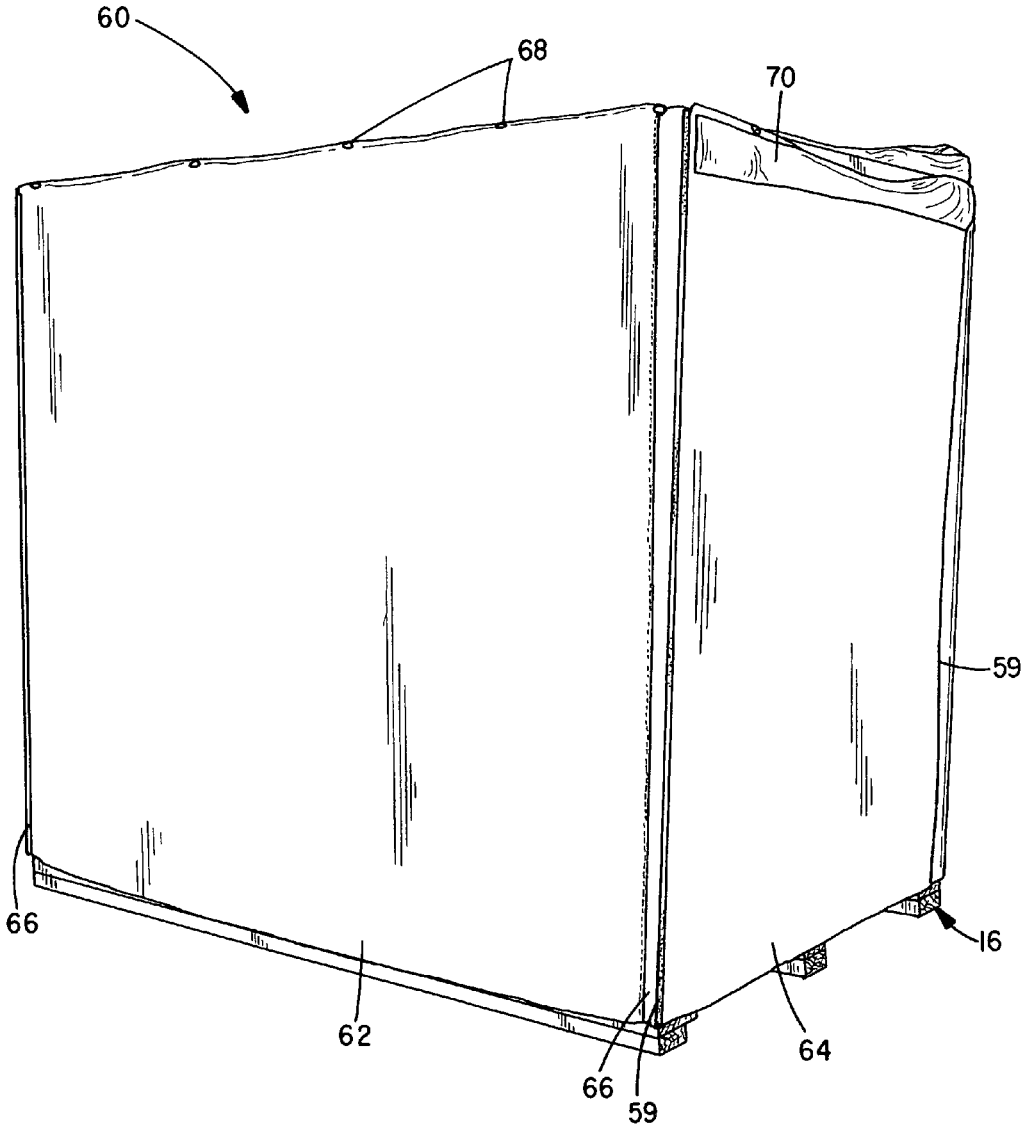
FIG. 3 is a perspective view showing a composite plastic and fabric sidewall assembly that attaches to the storage container cover piece.

The assembly 60 of FIG. 3 provides hard side and end panels 62 and 64. The panels 62 and 64 are formed from suitable sheet stock materials (e.g. pvc, plastic, ribbed plastic, HMWPE or UHMW materials, or other composites and materials compatible to the normal applications) and typically exhibit a thickness in the range of 0.1 to 0.2 inches. The panels 62 and 64 are interconnected at aligned edges with flexible corner strips 66. The strips 66 when constructed of fabric provide flexion to facilitate fitting the assembly 14 over a container 16. The top edges of the side panels 62 and the end panels 64 or attached stripping 66 are secured to the sub frame assembly 40 with suitable fasteners 68. Where one of the panels 64 is to serve as a door cover, a fabric hinge piece 70 is secured to the door panel 64 and lengths of hook and loop fastener material 59 are attached to the panel 64 and the adjoining hinge strips 66. The front panel 64 can be detached and displaced to provide access to a covered door 19.

Figure 4:
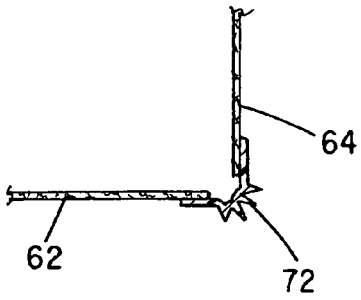
FIG. 4 is a partial top plan view to a corner of a plastic walled sidewall assembly with accordion shaped hinge pieces.

Although fabric edge/hinge strips 66 perform satisfactorily, FIG. 4 shows a strip of an alternative expansible stripping piece 72 having several folded webs that exhibit an accordion-shaped profile and that interconnect the panels 62 and 64. Tabs of hook and loop material 59 can again be used at the edge strips 72 in combination with a door covering panel 62 or 64 to selectively expose the door 20. The stripping pieces 72 can also be bonded or welded to the panels 62 and 64 with adhesives, thermal or sonic welding, mechanically as by sewing, or with fasteners. The expansible stripping pieces 72 can also exhibit other folded profiles, but desirably expand and contract during the fitting of the cover 60.

Figure 5:
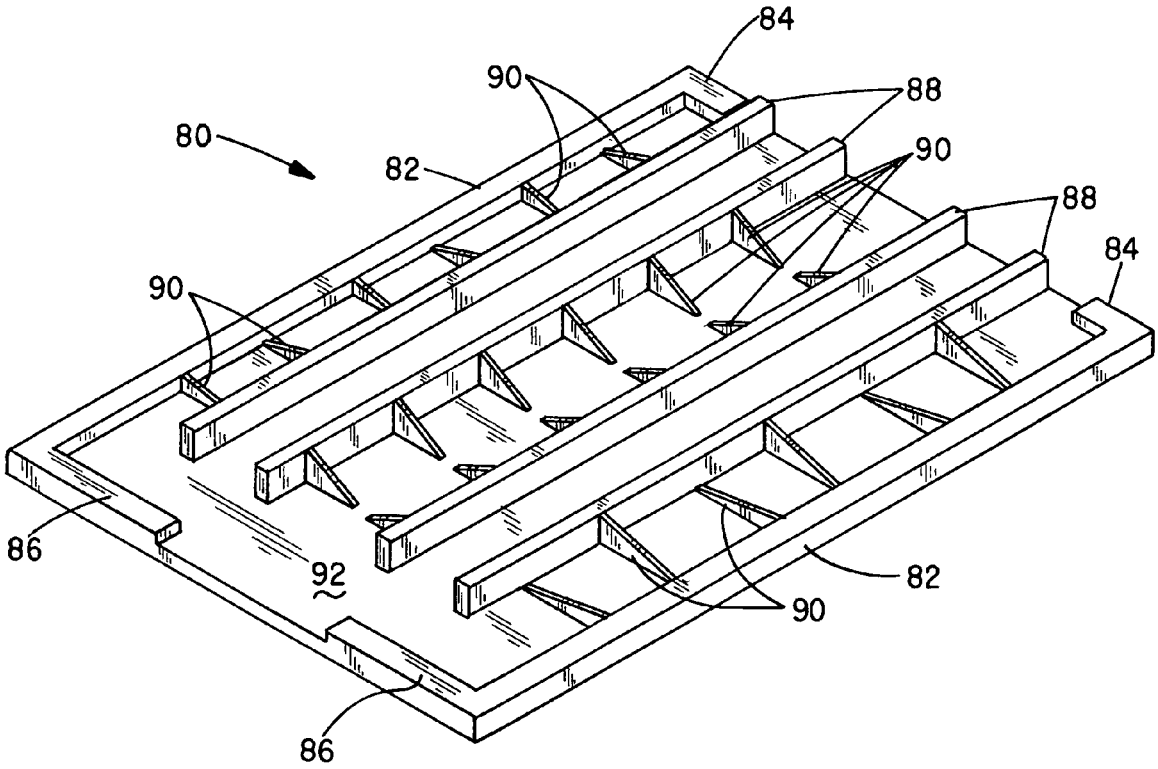
FIG. 5 is a perspective view showing front, left side and top views to the improved storage container cover of FIG. 1 with molded truss supports projecting from the channels.

With attention to FIG. 5, an alternative cover piece 80 is shown in perspective view. The cover piece 80 provides side and corner rail sections 82, 84 and 86 that substantially circumscribe intermediate channel rails 88. Right triangular trusses 90 project from a top panel piece 92 and are aligned to stabilize and enhance the load bearing capacities of the rails 82 and 88. The rails 88 and 26 and covers 10 and 80 are constructed to support nominal working loads of 1000 to 2000 pounds. The trusses 90 are organized to channel water and ice off the cover 80.

Figure 6:
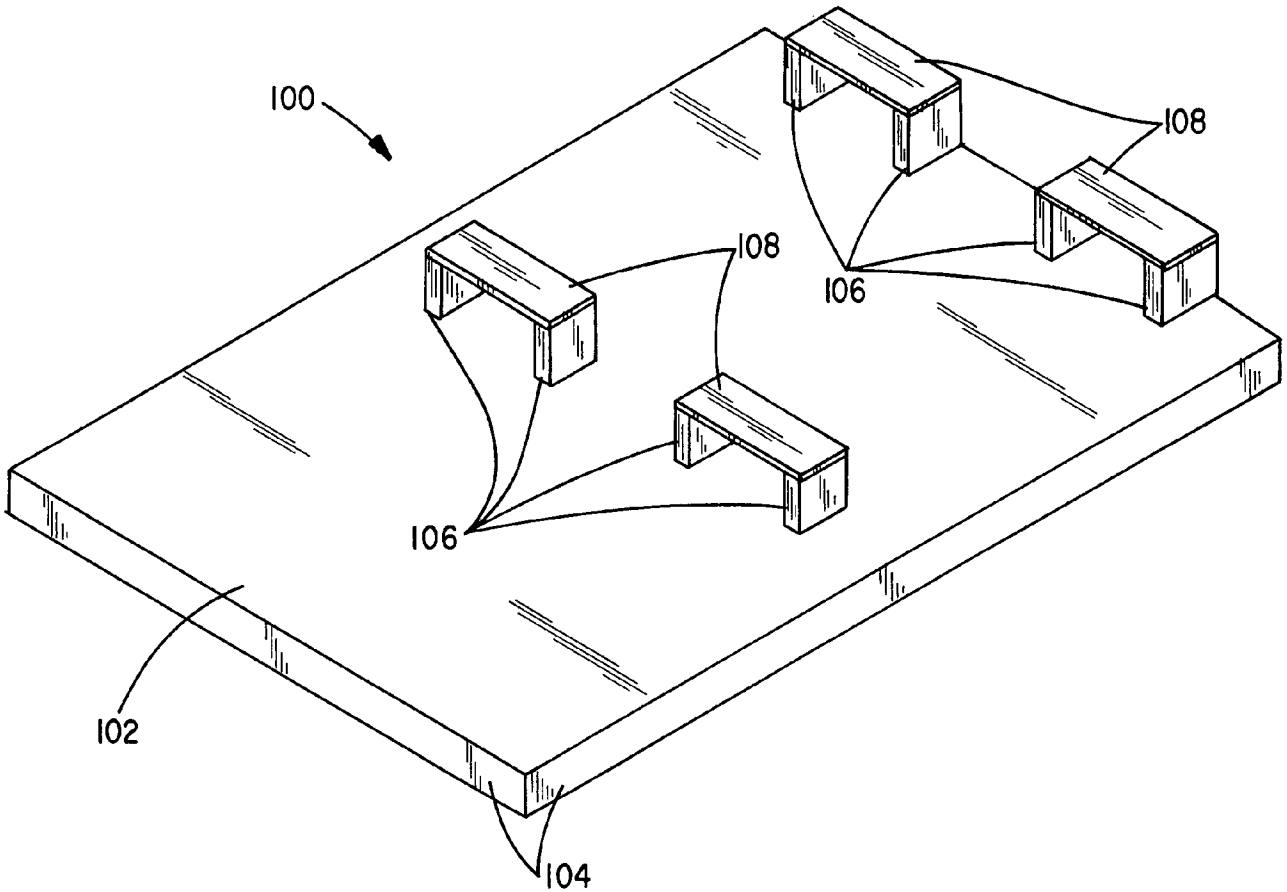
FIG. 6 is a perspective view showing an alternative flat-top storage container cover having raised tine receiving standoffs.

FIG. 6 depicts yet another molded cover piece 100 that provides a flat top panel piece 102 and depending peripheral flanges or sidewalls 104. Fastened or formed to the top panel 102 are multiple raised towers 106. Cross pieces 108 interconnect the towers 106 to facilitate the lifting of the cover piece 100. The towers 106 are typically formed with the cover piece 100 and may exhibit a hollow cavity space. Alternatively, solid blocks of suitable material can be attached to the top panel 102 with a variety of threaded fasteners, rivets, or can be bonded to the top panel 102 with adhesives, welding or other techniques. The towers 106 project from the top panel 102 sufficiently to receive the tines of a fork lift or other lifting device inserted between the panel 102 and the cross pieces 108.

The panel and sidewall pieces 102, 104 and towers 106 are constructed of high density plastics, although a variety of weather and UV resistant materials can be used. The cover piece 100 as well as the covers 10 and 80 can be formed using a variety of techniques, including machining, vacuum forming, roto-molding, and blow molding, among other processes.

Figure 7:
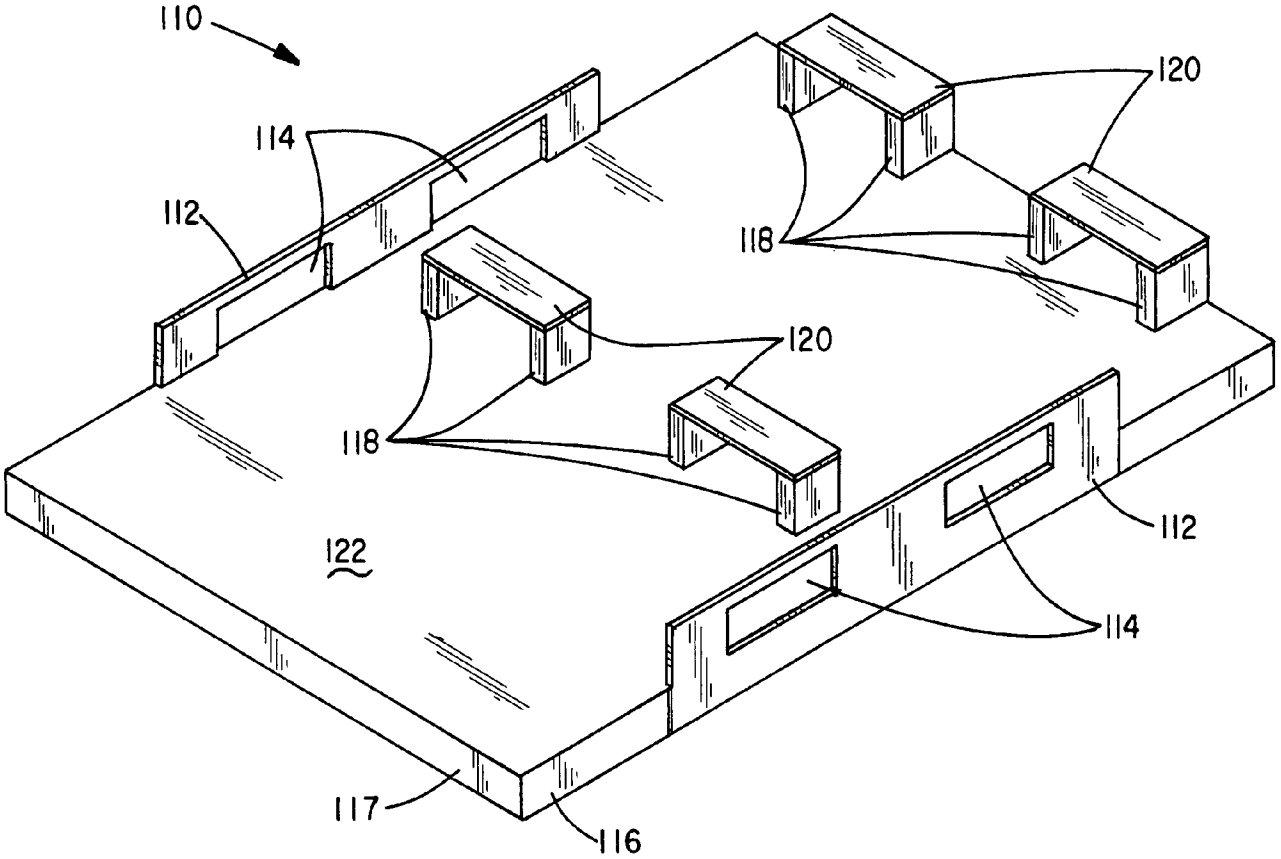
FIG. 7 is a perspective view showing an alternative flat-top storage container cover having raised tine receiving standoffs and side mounted tine receiving support plates.

FIG. 7 shows another alternative container cover piece 110 wherein side panels 112 having apertures 114 are fastened, bonded or integrally formed to side and/or end walls 116 and 117 of the cover piece 110. Several intermediate raised towers 118 and cross pieces 120 project from a top panel 122. The towers 118 and/or panels 112 project from the top panel 122 sufficiently to receive the times of a fork lift or other lifting device inserted between the panel 122 and the cross pieces 120 or through the apertures 114. The towers 118 and/or panels 112 are located to facilitate access to grip the cover piece 110 from either a longitudinal end upon supporting fork lift tines through the spaces between the panel 122 and cross pieces 120 or at a side by inserting the tines through the oppositely aligned apertures 114.

Figure 8:
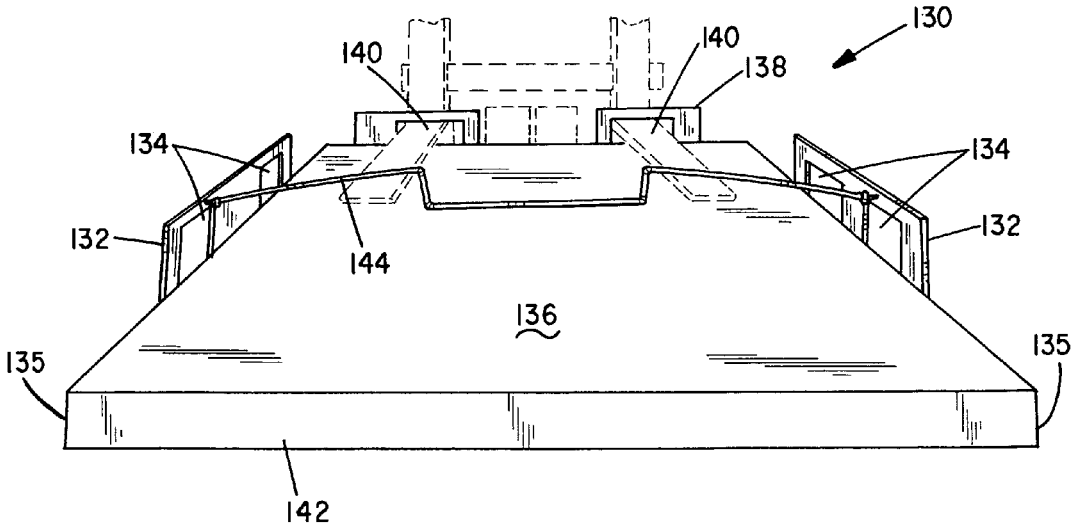
FIG. 8 is a perspective view showing an alternative flat-top storage container cover having side and end mounted tine receiving support plates and cross straps.
Figure 9:
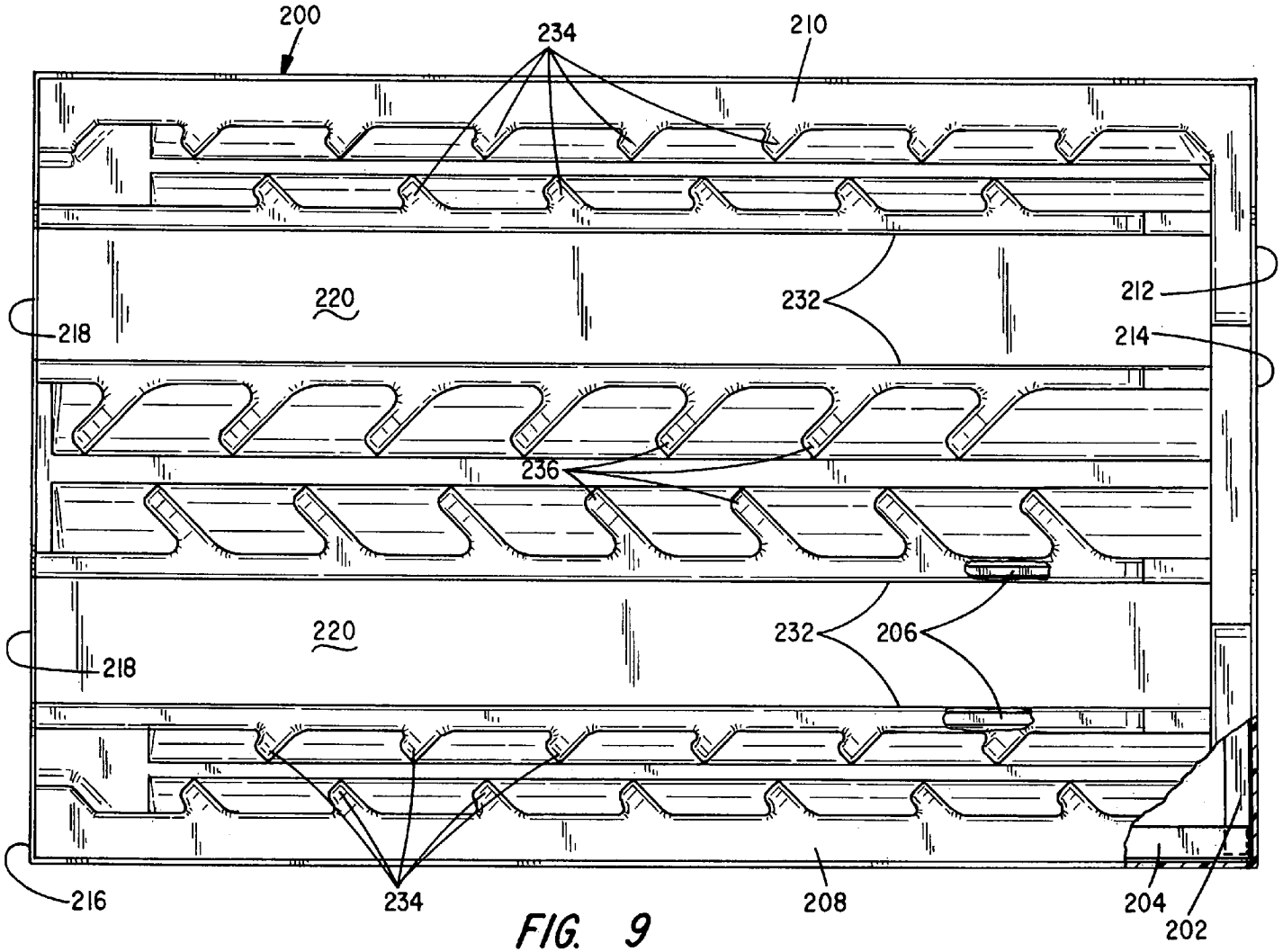
FIG. 9 shows a top plan view to a molded base cover piece.
Figure 10:
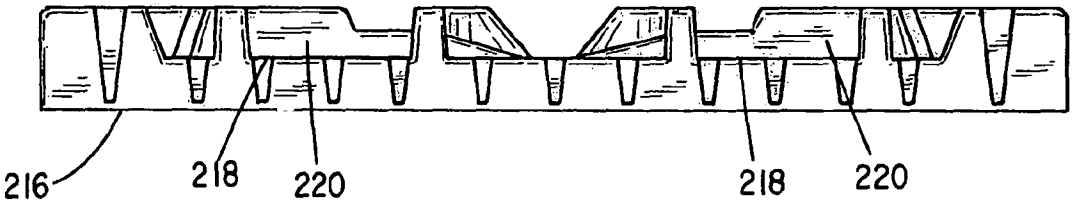
FIG. 10 shows a plan view to a tine receiving end of the molded base piece of FIG. 9.
Figure 11:
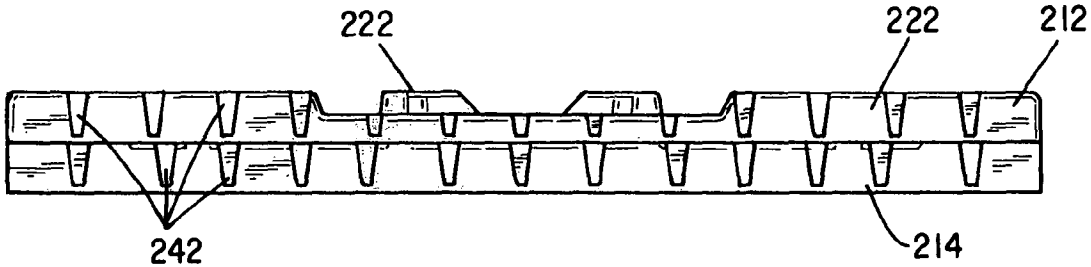
FIG. 11 shows a plan view to a closed end of the tine receiving channels of the molded base piece of FIG. 9.

FIG. 8 shows still another alternative container cover piece 130 having side panels 132 with apertures 134 that mount to side walls 135 and extend above a thermo formed top panel 136. End wall panels 138 with apertures 140 mount to an end wall 142. The panels 132 and 138 can be integrally formed with the top panel 136 or can be fastened or bonded to the depending side and end wall panels 135 and 142 that depend or project downward about the circumferential periphery of the panel 136.

Suspended between the side panels 132 is a tension member 144 that overlies the top panel 136. The member 140 can be constructed of a variety of flat or rod stock materials, rope or other stranded or flexible materials. The tension member 144 in combination with the end panel 138 supports the weight of the cover piece 130 when raised with a fork lift. The cover piece 130 is raised or lowered from a longitudinal end upon supporting fork lift tines through the apertures 140 and beneath the member 144 or from the sides upon inserting the tines through the oppositely aligned apertures 134.

Although not shown, it is to be appreciated the covers 100, 110 and 130 can be used alone or can include a sub frame similar to the assembly 40. The members of such a sub-framework secure an appropriate side wall assembly 14 to the covers 100, 110 or 130 and strengthen the covers to withstand any overlying, supported container 16.

In lieu of mounting and fastening cap pieces 32 or 34 to the rails 26 and 88 of the cover pieces 12 and 80, FIGS. 9 through 17 depict several improved alternative storage container cover assemblies. The cover assemblies are configured from two sections. The two sections are presently molded and layered/laminated onto each other during a continuous molding process. The base piece is first molded from a base substrate or piece of plastic sheathing and after which while preferably still warm, a cap piece is molded from a cap substrate or piece of plastic sheathing onto the base piece under suitable pressure and temperature conditions to thermally bond and coalesce the two layers together at included contact surfaces.

Thermal bonding occurs at the points and surfaces where the base piece and cap piece layers contact each other, and particularly at the tops of perimeter rails, longitudinal rails that define tine receiving channels and surfaces aligned to strap receiving channels. Bonding also occurs at perimeter sidewalls and edges where any folded edges of the cap piece are depressed into recessed pockets. Molded gussets and/or trusses are arrayed to intersect and/or project from the sidewalls of appropriate rails to stabilize and generally strengthen the cover assemblies and particularly the tine receiving channels. Suitable embossing is also provided in the base and cap pieces to enhance the bonding and strengthen the cover assemblies.

With attention to FIGS. 9 through 12, top, opposite end and front side views are shown to a base piece 200 that is molded from a sheet of plastic or other suitable base substrate material. The base piece 200 is sized to span the length and width of a container 16 and suitably drape over perimeter edges of the container top. The base piece 200 is depicted in partial section to expose wood, mortise and tenon sub-frame members 202, 204 and 206 that are suitably fastened to raised channels or rails at the base piece 200. Longitudinal perimeter edge or side rails 208 and 210 receive 3×3½-inch members 204. A lateral cross rail 212 spans an end 214 opposite an end 216 that contains tine receiving ports 218. The rail 212 contains lapped 1×4-inch tenon members 202 that fasten to the members 204 at the corners as shown in the cutaway corner section.

Figure 13:
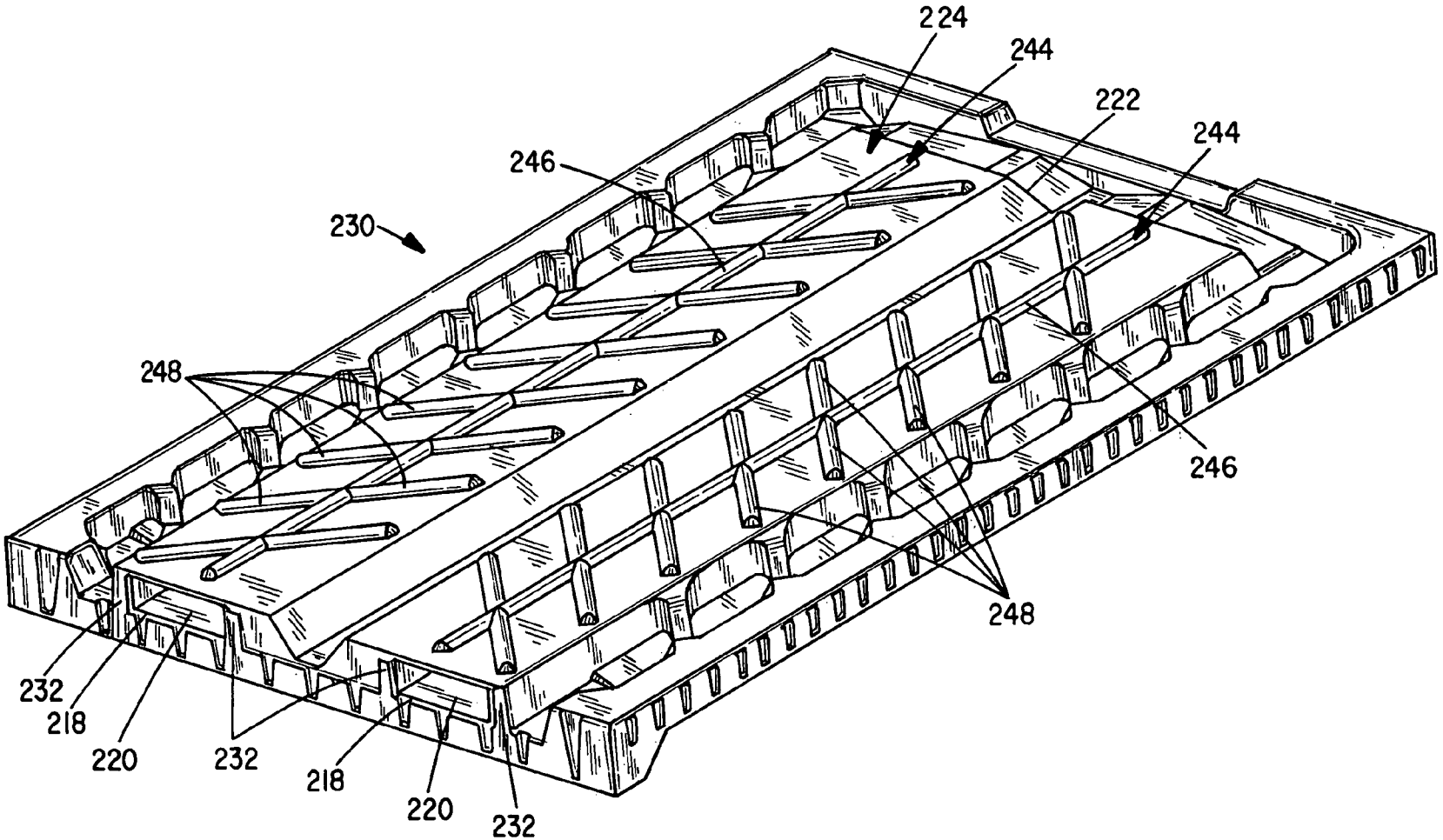
FIG. 13 shows a perspective view of a partial cap piece bonded to the base piece of FIG. 9.

Recessed channels 220 extend from the ports 218 to a wall surface 222 short of the end 214, see FIG. 13. The tine receiving channels 220 are covered and terminated by a cap piece 224. The bottom surface of the cap piece 224 is suitably bonded to the adjoining longitudinal rails 232. Although the tine receiving channels 220 are enclosed and terminate for the cover assembly 230, the channels 220 could be continued with suitable modification to the base piece 200 to permit tine access to the cover at either end 216 or 214. Similarly, transverse tine receiving access ports (not shown) could be formed into and through the perimeter rails 208 and/or 210 and raised intermediate longitudinal rails 232 that define the sidewalls of the tine receiving channels 220 along one or both longitudinal sides of the base piece 200.

Displaced along the length of the perimeter rails 208 and 210 and longitudinal tine rails 232 are several transversely intersecting, raised or embossed gusset or brace pockets 234 and 236 of differing length. The gusset pockets 234 and 236 project at acute angles to the longitudinal rails 208, 210 and 232 and stiffen the sidewalls of the rails 208, 210 and 232. Sufficient strength and stability is provided by the gusset pockets 234 and 236 at the sidewalls of the rails 232 to avoid the need for stiffeners 206 (e.g. wood 2×2-inch), although the available cavities could accept any suitable stiffener 206 of any of a variety of constructions and material types.

Figure 12:
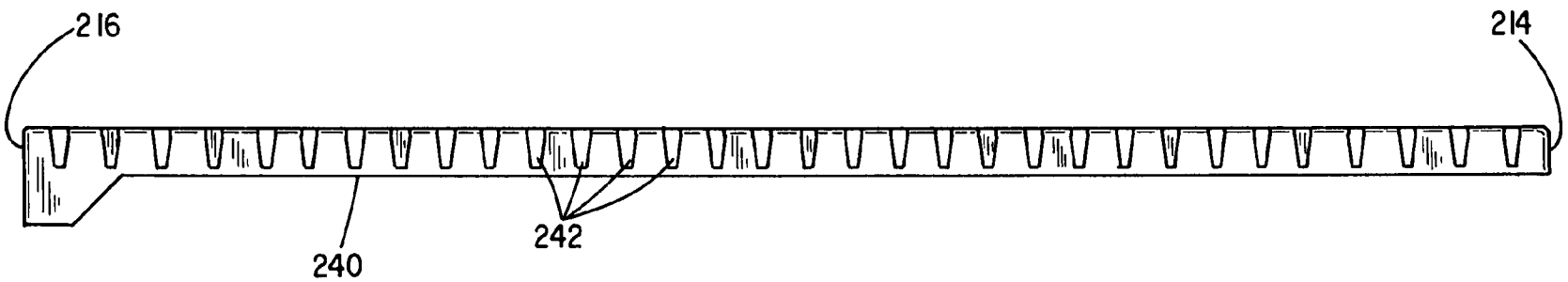
FIG. 12 shows a plan view to a side of the molded base cover piece of FIG. 9.

FIG. 12 depicts one of two symmetrical, longitudinal sides 240 of the base piece 200. Recessed or embossed into the side 240 and ends 214 and 216 are depending, recessed pockets 242. The pockets 242 stabilize and strengthen the depending perimeter edge side walls of the base piece 200. The pockets 242 also accept and contain portions of the partial cap piece 224 or any other cap piece that is sized to fold over the perimeter longitudinal sidewalls or end walls of the base piece 200. That is, upon heating, bending and compressing the cap piece 224 against the pockets 242, the heated material compresses into and bonds to the cover sidewalls containing the mating pockets 242. The cap piece 224 is thus secured via the numerous thermal bonds and the mechanical interconnection at the pockets 242 at the ends 214 and 216.

Returning attention to FIG. 13 and also formed into the cap piece 224 to align with the underlying tine channels 220 are embossed, ridged or raised ladder structures 244. A longitudinal raised ridge member 246 extends the length of each channel 220 and cross arms 248 transversely intersect with the member 246 to overly the tine rails 232. The embossed ladder structure 244 stabilizes and prevents deformation of the cap piece 224 and/or cover assembly 200 during normal raising/lowering operations.

Figure 14:
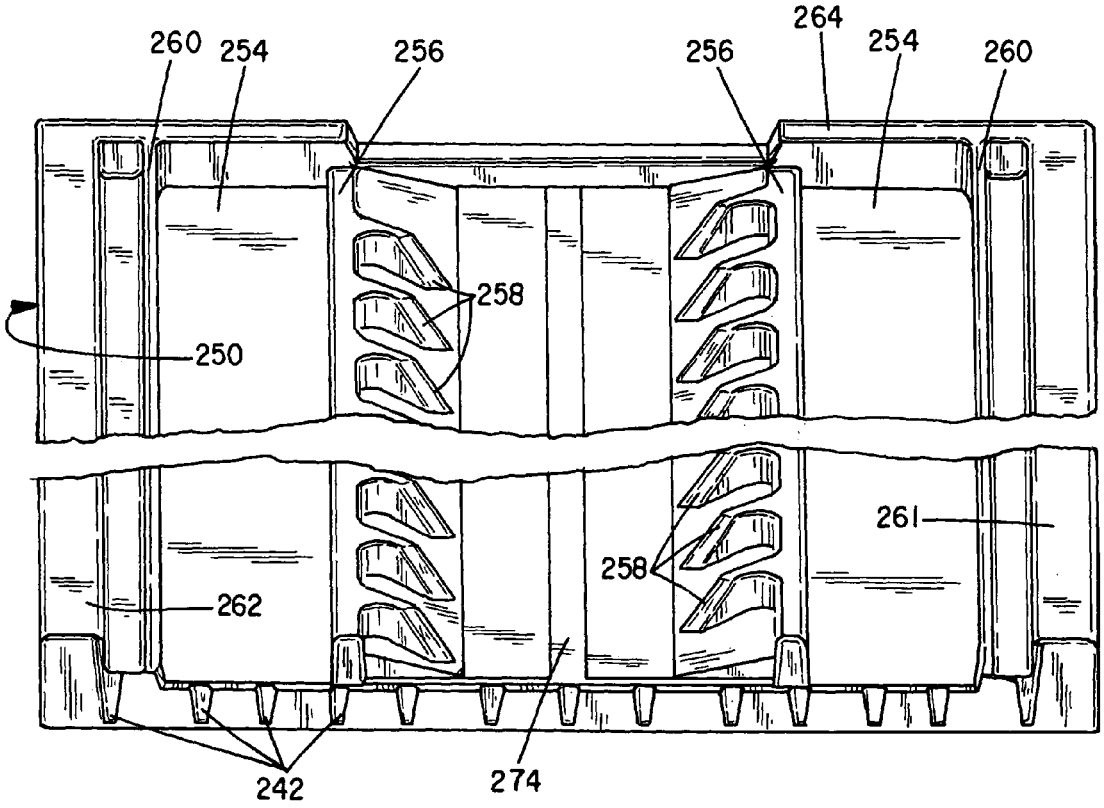
FIG. 14 shows a foreshortened perspective view to an alternative molded base cover piece.
Figure 15:
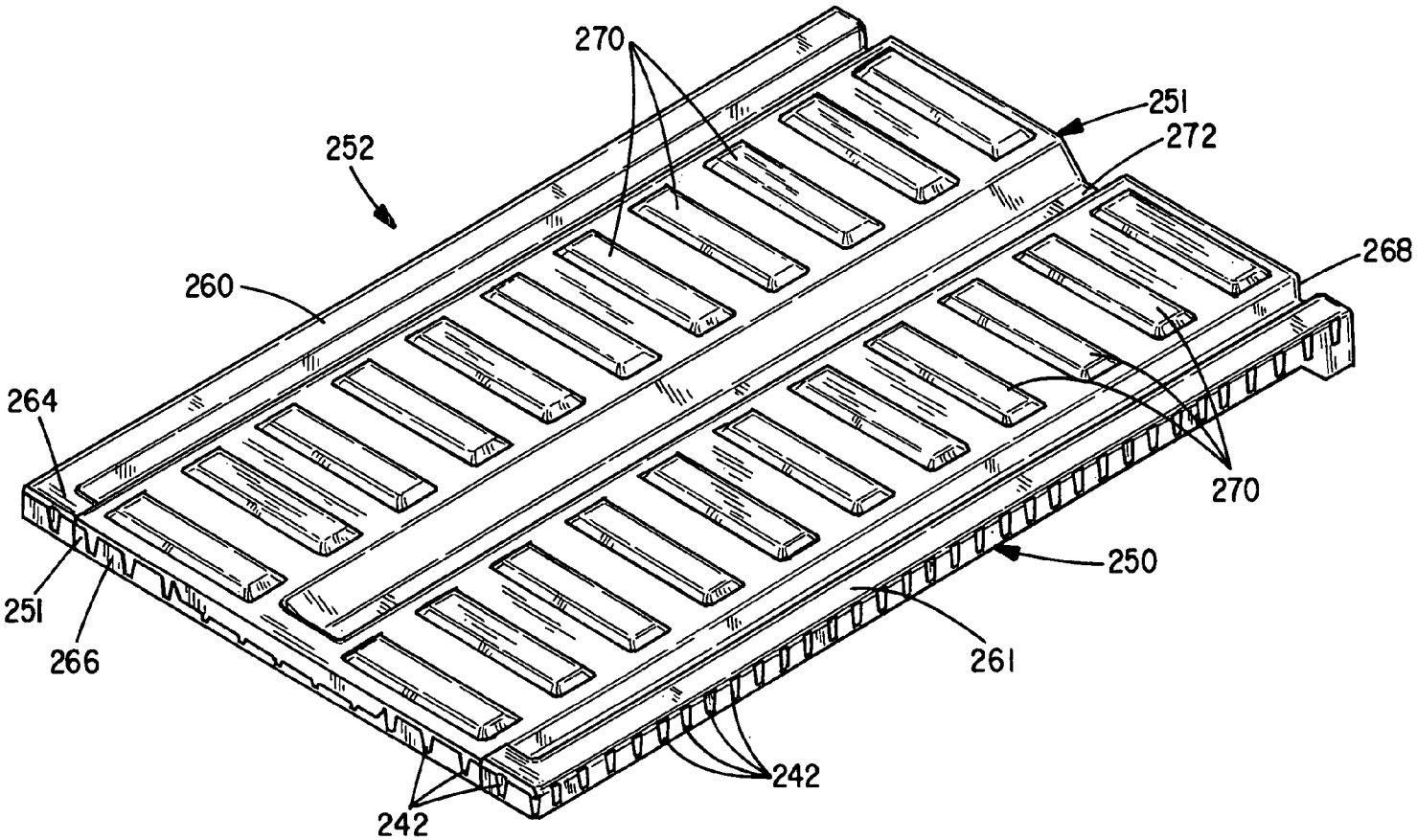
FIG. 15 shows a perspective view of a partial cap piece bonded to the base piece of FIG. 14.

FIGS. 14 and 15 depict a modified base piece 250 and a full-length mating cap piece 251 having rectangular embossed stiffener surfaces 270 alone and assembled as a complete cover assembly 252. The base piece 250 provides left and right, closed-end tine receiving channels 254. Longitudinal rails 256 that extend at the center of the base piece 250 have integral transecting gusset/braces 258 and form one sidewall of each tine receiving channel 254. The rails 256 as with the longitudinal rails 232 are sufficiently wide to receive suitable stiffeners 206.

Relatively narrow longitudinal rails 260 displaced laterally from the rails 256 extend to define the opposite sidewalls of the tine receiving channels 254. Longitudinal perimeter edge rails 260 and 261 extend along the edges of the cover assembly 252 and contain 3×3½-inch stiffener supports 204 (not shown). A cross rail 264 extends between the perimeter rails 260 and 262 and contains laminated 1×4-inch stiffener supports 202 (not shown).

The cap piece 251 extends the length of the base piece 250, folds over end walls 266 and 268 of the base piece 250 and spans the space between the rails 260 and 262. The cap piece 251 is thermally bonded to the tops of the rails 256, 260 and 262 and to the end walls 266 and 268. A series of embossed or raised rectangular surfaces 270 span and extend the length of each tine receiving channel 254.

A recessed center longitudinal surface 272 extends between the columns of embossed surfaces 270 and is thermally bonded to a surface 274 at the base piece 250. The surface 272 accommodates water runoff and typically supports a fastener strap that is secured over the cover assembly and container 16.

Figure 16:
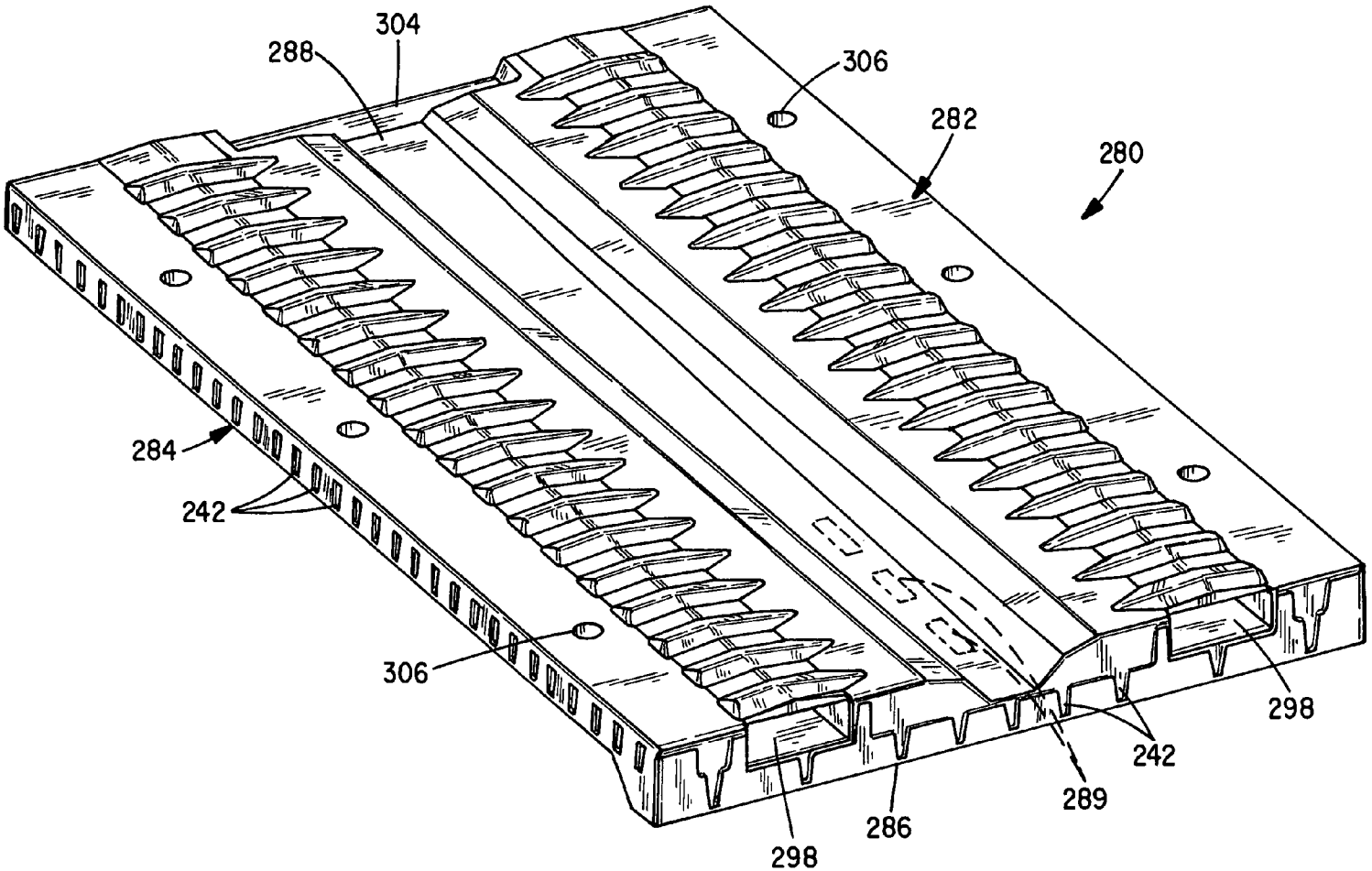
FIG. 16 shows a perspective view of a full cover cap piece bonded to the base piece of FIG. 14.
Figure 17:
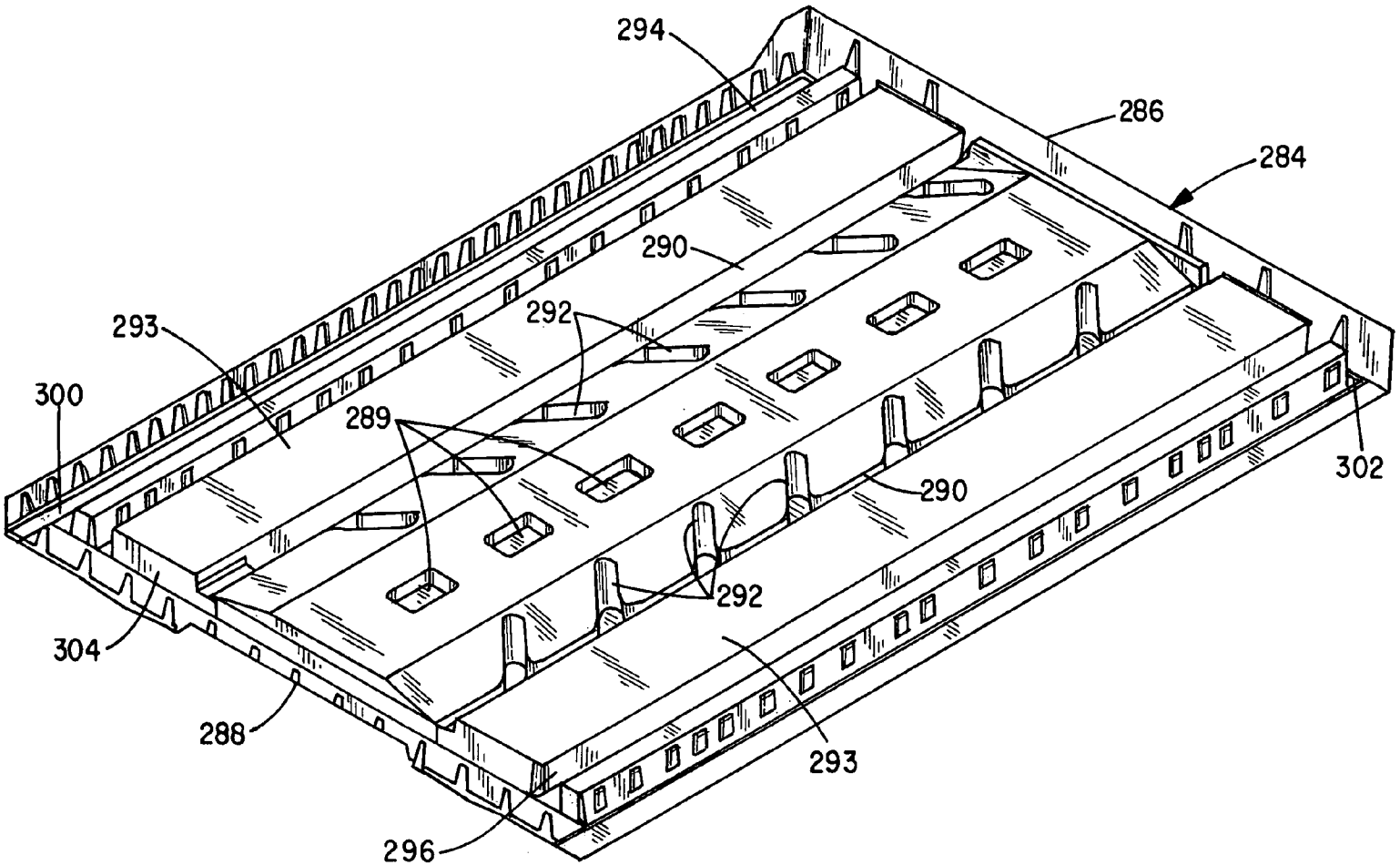
FIG. 17 shows a perspective view to the bottom of the molded base piece of FIG. 14 and depicting the raised strap support pockets.

FIGS. 16 and 17 depict perspective views to another container cover assembly 280. FIG. 16 depicts a top view and FIG. 17 depicts a bottom view. A full length cap piece 282 is thermally bonded to a base piece 284 and extends over a tine receiving lifting end 286 and a closed end 288. The base piece 284 is substantially similar to the base piece 250, except for a column of raised or embossed pockets 289 that extend along a center strap surface 288. Raised longitudinal rails 290 and integral gusset braces 292 extend along the center of the assembly 280 and form sidewalls of tine receiving channels 293. The rails 290 are sufficiently wide to accept suitable stiffeners 206 (not shown).

Narrower rails 294 and 296 are displaced laterally from the rails 290 and extend longitudinally to form the opposite sidewalls of the tine receiving channels 293. Raised perimeter rails 300 and 302 extend along the longitudinal perimeter edges of the base 284 and intersect a raised end cross rail 304. The exposed hollow pocket or channel spaces of the raised rails 300, 302 and 304 visible in the bottom view of FIG. 17 support 3×3½-inch and 1×4-inch stiffeners 204 and 202 (not shown). Bores 306 formed into the cap piece 282 contain suitable fasteners (e.g. bolts, screws (not shown)) that are secured to the cover 280 and perimeter stiffeners.

Figure 18:
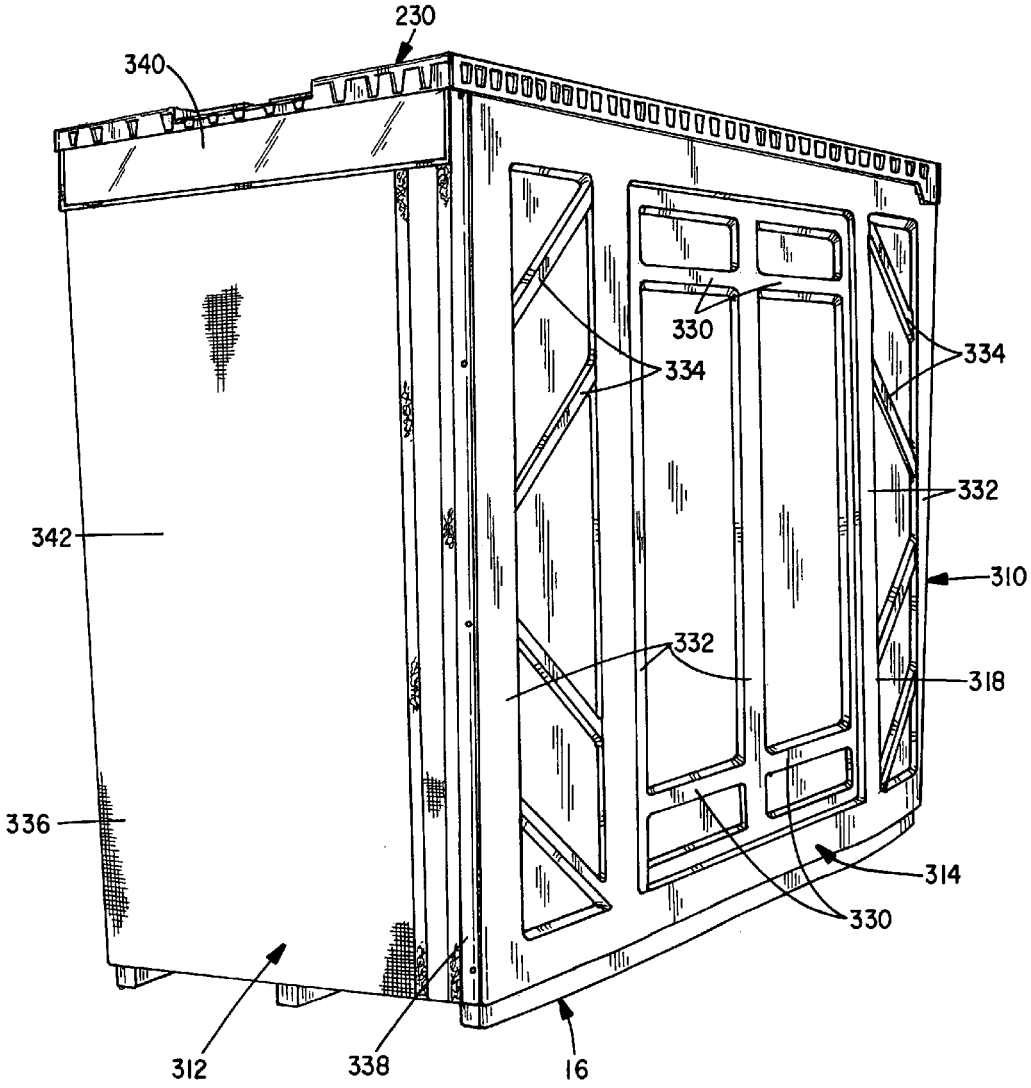
FIG. 18 shows a perspective view of the door end and right side of the cover assembly of FIG. 13 mounted to a hard-sided side wall assembly and fitted over a storage container and wherein the wall assembly has two L-shaped side wall sections and a multi-panel fabric door end wall.
Figure 19:
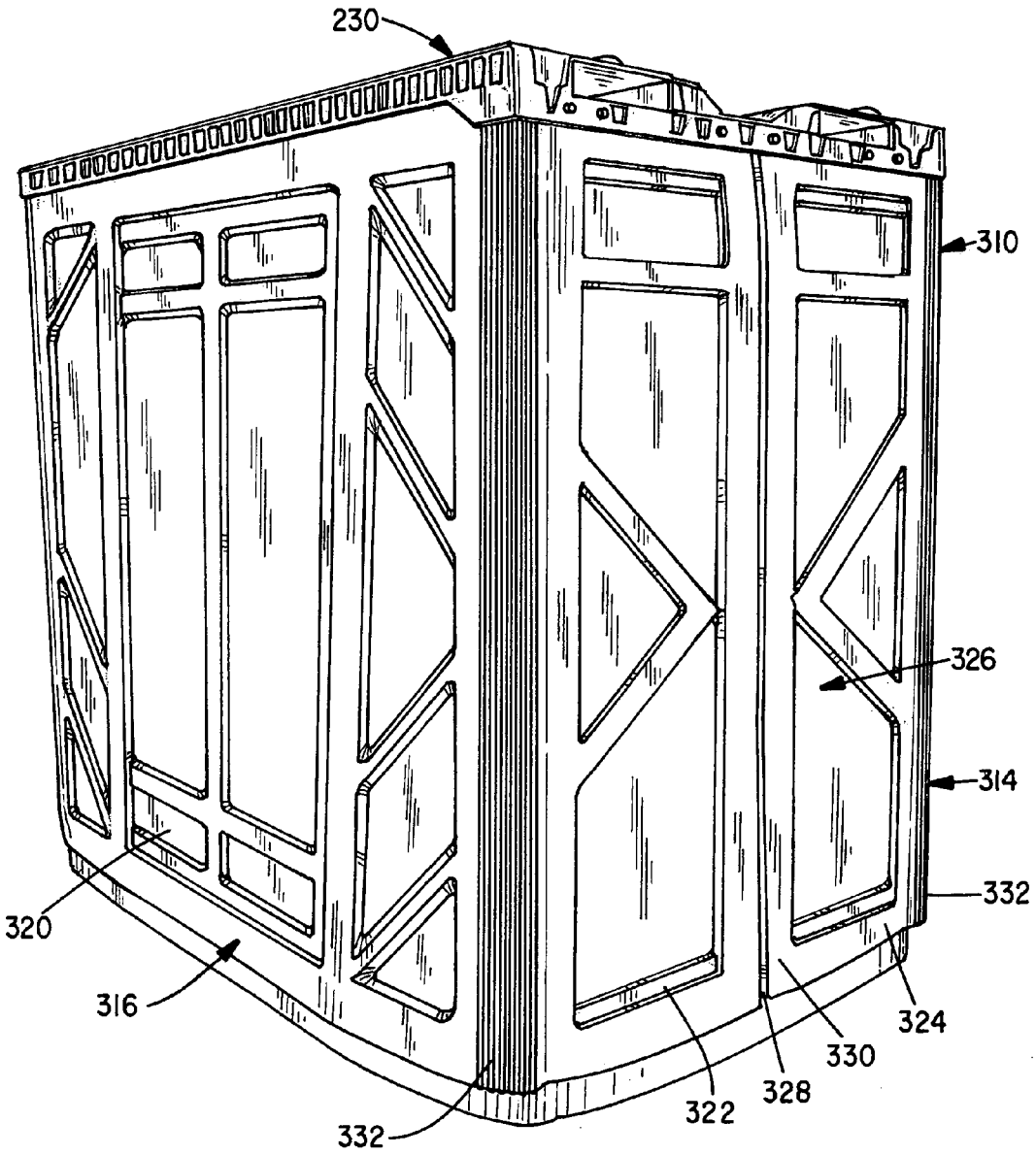
FIG. 19 shows a perspective view of the cover and hard-sided side wall assembly of FIG. 18 depicting the left right side and tine receiving end of the hard-sided side wall assembly and the coupled edges of the two L-shaped side wall sections.

FIGS. 18 and 19 lastly depict perspective views to a multi-walled sidewall cover assembly 310 that can be attached to any of the foregoing cover assemblies 230, 252, 280 or any of the other earlier described cover assemblies. The sidewall assembly 310 provides a multi-section fabric end wall panel 312 that attaches to symmetrical, "living" hinged, L-shaped panels 314 and 316 that define right and left sidewalls 318 and 320 and adjoining halves 322 and 324 of an end wall 326.

The panels 312, 314 and 316 are secured to the associated cover assembly (e.g. 280) with suitable fasteners. Vertical peripheral edges 328 and 330 of the end wall pieces 322 and 324 are overlapped and secured with suitable fasteners (e.g. VELCRO® strips, adhesive strips, rivets or mechanical fasteners). Flexible vertical, "living" joints or hinges 332 extend the height of the intersecting corners of the panels 314, 324 and 316, 322. The hinges 332 facilitate mounting of the sidewall assembly 310 around and over a storage container 16.

Raised or embossed rails 330, stiles 332 and angular surfaces 334 are molded into the panel pieces 314, 324 and 316, 322 to stiffen the panel pieces 314, 324 and 316, 322. The sidewall cover 310 also provides an aesthetically pleasing ornamental appearance versus the drab wooden panels of the underlying storage container 16. A storage container 16 can thus be supported in a variety of locations visible to normal traffic flow in an eye appealing manner.

The multi-section fabric end wall panel 312 provides a number of perimeter flap pieces 336, 338 and 340 that interconnect with a center door flap 342. Suitable overlapping lengths of hook and loop fastener material are presently used to provide a detachable fastening and permit exposure of a covered, hinged door in the covered storage container 16.

While the invention has been described with respect to a presently preferred and several alternative assemblies and considered improvements, modifications and/or alternatives thereto, still other assemblies and combinational arrangements may be suggested to those skilled in the art. The foregoing description should therefore be construed to include all those embodiments within the spirit and scope of the following claims.

What is claimed is:

1. A molded plastic storage container cover comprising:

a) a base piece molded from a sheet of plastic having top and bottom surfaces, wherein a plurality of raised perimeter rails project from and are displaced about perimeter edges of the top surface, wherein a plurality of raised longitudinal channel rails project from the top surface in displaced parallel relation to each other, and wherein each of said plurality of raised perimeter and channel rails subtends an open channel space exposed at the bottom surface of said base piece; and b) a cap piece molded from a sheet of plastic having top and bottom surfaces, wherein the bottom surface of said cap piece is thermally bonded to the top surfaces of the perimeter and channel rails of said base piece rails to enclose at least first and second open-ended channels sized and arranged to receive tines of a lifting device, whereby the cover can be raised and lowered.

2. A storage container cover as set forth in claim 1 wherein a plurality of rigid members are contained in the bottom surface channel spaces of a plurality of said perimeter and channel rails at the base piece to stiffen said cover.

3. A storage container cover as set forth in claim 1 wherein a plurality of peripheral sidewalls of said base piece include a plurality of recessed depressions.

4. A storage container cover as set forth in claim 1 wherein said base piece and cap piece exhibit generally rectilinear shapes, wherein peripheral edge sidewalls of said base piece at opposite ends of said first and second channels include a plurality of recessed depressions, and wherein peripheral edges of said cap piece fold over and are received in the recessed depressions.

5. A storage container cover as set forth in claim 1 including a plurality of stiffener members mounted in the channel spaces of a plurality of said perimeter rails, and wherein a plurality of flexible side wall panels are secured to said perimeter rails to depend downward from said cover and drape about an interior space of sufficient size to encase a storage container supporting said cover.

6. A storage container cover as set forth in claim 5 wherein at least one of said flexible side walls is comprised of fabric and wherein a plurality of fasteners are arrayed about at least one other of the side walls to detachably fasten and hinge the fabric side wall to the other side walls.

7. A storage container cover as set forth in claim 6 wherein intersecting plastic walls are coupled together with elongated hinge members comprising a plurality of folded webs.

8. A storage container cover as set forth in claim 5 wherein a plurality of said flexible side walls comprise a molded plastic sheathing and wherein a plurality of fasteners are arrayed at one plastic side wall to detachably fasten and hinge at least one wall to anther side wall.

9. A storage container cover as set forth in claim 8 wherein adjoining pairs of said plastic walls are coupled together with fabric members.

10. A storage container cover as set forth in claim 1 including first and second L-shaped sidewalls mounted to peripheral edges of said cover to depend downward, wherein a plurality of fabric panels are detachably secured to said first and second L-shaped walls and to other fabric panels to selectively fasten and unfasten to permit access to a storage container supporting said cover.

11. A storage container cover as set forth in claim 10 wherein said first and second L-shaped sidewalls include a plurality of embossed surface portions.

12. A storage container cover as set forth in claim 1 wherein said cap piece includes a plurality of embossed surface portions aligned to project above said first and second open-ended channels.

13. A storage container cover as set forth in claim 1 wherein said base piece includes a plurality of raised pockets that project from a top surface of said base piece and wherein said cap piece is bonded to the top surface portions of said pockets.

14. A molded plastic storage container cover comprising:

a) a base piece molded from a sheet of plastic having top and bottom surfaces, wherein a plurality of raised hollow perimeter rails project from and are displaced about perimeter edges of the top surface and comprise a plurality of peripheral side wall edges of said base piece, wherein a plurality of raised longitudinal hollow channel rails project from the top surface and are aligned in displaced parallel relation to each other, and wherein each of said plurality of raised perimeter and longitudinal channel rails subtends a hollow open channel space exposed at the bottom surface of said base piece;

b) a plurality of rigid members mounted in the hollow open channel spaces of said perimeter rails; and c) a cap piece molded from a sheet of plastic having top and bottom surfaces, wherein the bottom surface of said cap piece overlies and is thermally bonded to uppermost surfaces of said plurality of channel rails to enclose first and second open-ended channels sized and arranged to receive tines of a lifting device, and wherein said cap piece includes a plurality of embossed surface portions that are aligned to project above said first and second open-ended channels, whereby the cover can be raised and lowered by a lifting device.

15. A storage container cover as set forth in claim 14 wherein said cap piece is thermally bonded to uppermost surfaces of said perimeter and channel rails, wherein peripheral edge sidewalls of said base piece include a plurality of recessed depressions and wherein peripheral edges of said cap piece are folded over, compressed into and thermally bonded to the recessed depressions of the mating sidewalls of said base piece at opposite ends of said first and second channels.

16. A molded plastic storage container cover comprising:

a) a base piece molded from a sheet of plastic having top and bottom surfaces, wherein a plurality of raised hollow perimeter rails project from and are displaced about peripheral edges of the base piece, wherein a plurality of raised longitudinal hollow channel rails project from the top surface and are aligned in displaced parallel relation to each other, and wherein each of said plurality of raised perimeter and channel rails subtends a hollow open channel space exposed at the bottom surface of said base substrate;

b) a plurality of wooden members mounted in the hollow open channel spaces of at least said perimeter rails;

c) a plastic cap piece molded from a sheet of plastic, wherein said cap piece overlies and is thermally bonded to uppermost surfaces of said plurality of channel rails to enclose at least first and second open-ended channels sized and arranged to receive tines of a lifting device and wherein said cap piece includes a plurality of embossed surface portions that are aligned to project above said first and second open-ended channels; and c) first and second L-shaped plastic sidewalls secured to peripheral edges of said base piece to depend downward, wherein a plurality of fabric panels are detachably secured to said first and second L-shaped walls and to other fabric panels secured to said base piece to enclose an interior space, whereby the base piece, cap piece and secured sidewalls cover can encase a storage container in the interior space and be raised and lowered by a lifting device.

17. A molded plastic storage container cover comprising:

a) a base piece molded from a sheet of plastic having top and bottom surfaces, wherein a plurality of raised perimeter rails project from and are displaced about perimeter edges of the top surface, wherein a plurality of raised longitudinal channel rails project from the top surface in displaced parallel relation to each other, and wherein each of said plurality of raised perimeter and channel rails subtends an open channel space exposed at the bottom surface of said base piece, and including a plurality of rigid members mounted in the channel spaces of a plurality of said perimeter rails, and wherein a plurality of flexible side wall panels are secured to said perimeter rails to depend downward from said cover and drape about an interior space of sufficient size to encase a storage container supporting said cover; and b) a cap piece molded from a sheet of plastic having top and bottom surfaces, wherein said cap piece overlies and is bonded to portions of said plurality of channel rails to enclose at least first and second open-ended channels sized and arranged to receive tines of a lifting device, whereby the cover can be raised and lowered.

18. A molded plastic storage container cover comprising:

a) a base piece molded from a sheet of plastic having top and bottom surfaces, wherein a plurality of raised perimeter rails project from and are displaced about perimeter edges of the top surface, wherein a plurality of raised longitudinal channel rails project from the top surface in displaced parallel relation to each other, wherein each of said plurality of raised perimeter and channel rails subtends an open channel space exposed at the bottom surface of said base piece, and wherein said base piece includes a plurality of raised pockets that project from a top surface of said base piece; and b) a cap piece molded from a sheet of plastic having top and bottom surfaces, wherein said cap piece overlies and is bonded to top surface portions of said pockets and to portions of said plurality of channel rails to enclose at least first and second open-ended channels sized and arranged to receive tines of a lifting device, whereby the cover can be raised and lowered.

* * * * *